United States Patent [19]

Nauerth

[11] 4,327,282

[45] Apr. 27, 1982

[54] ELECTRICAL RESISTANCE HEATING ELEMENT

[75] Inventor: Karl-Heinz Nauerth, Erlenbach, Fed. Rep. of Germany

[73] Assignee: Firma Fritz Eichenauer, Kandel, Fed. Rep. of Germany

[21] Appl. No.: 86,175

[22] Filed: Oct. 18, 1979

[30] Foreign Application Priority Data

Oct. 21, 1978 [DE] Fed. Rep. of Germany ..... 2845965

[51] Int. Cl.[3] ..... H05B 3/02

[52] U.S. Cl. ..... 219/541; 219/505; 219/539; 219/549; 219/553; 338/22 R; 338/22 SD; 338/220

[58] Field of Search ..... 219/505, 464, 528, 535, 219/541, 539, 544, 548, 549, 386, 553; 338/22 R, 22 SD, 23, 220, 268; 361/272; 174/52 R

[56] References Cited

U.S. PATENT DOCUMENTS

| | | | |
|---|---|---|---|
| 2,994,760 | 8/1961 | Pecoraro et al. | 219/541 X |
| 3,146,340 | 8/1964 | Dewey et al. | 219/544 X |
| 3,214,719 | 10/1965 | Turner | 338/22 R |
| 3,400,253 | 9/1968 | Marker | 219/541 |
| 3,535,494 | 10/1970 | Armbruster | 219/528 |
| 3,748,439 | 7/1973 | Ting et al. | 219/353 |
| 3,835,434 | 9/1974 | Kahn | 338/22 R |
| 3,924,222 | 12/1975 | Slocum | 332/22 R X |
| 3,955,170 | 5/1976 | Geishecker | 338/22 SD |
| 3,976,854 | 8/1976 | Ishikawa et al. | 338/22 R X |
| 3,995,141 | 11/1976 | Vieau et al. | 219/386 |
| 3,996,447 | 12/1976 | Bouffard et al. | 219/541 |
| 4,101,862 | 7/1978 | Takagi et al. | 338/23 |
| 4,104,509 | 8/1978 | Bokestal et al. | 219/544 |
| 4,147,927 | 3/1979 | Pirotte | 219/541 |

FOREIGN PATENT DOCUMENTS

| | | | |
|---|---|---|---|
| 2849584 | 5/1979 | Fed. Rep. of Germany | 338/220 |

*Primary Examiner*—Volodymyr Y. Mayewsky
*Attorney, Agent, or Firm*—Craig and Antonelli

[57] ABSTRACT

An electrical resistance heating element comprises at least one heating conductor of positive-temperature-coefficient material having contact means on opposite surfaces; if more than one, they may be arranged in a row or in a stack. Electrical connection is made to the heating conductor or the row or stack through two substantially plane contact plates adapted to the layout of the heating conductor, row or stack and placed loosely upon opposite contact surfaces thereof. The components are held together elastically by securing means holding the edges of the contact plates. Two alternative forms of securing means are described, one consisting of a series of U-shaped clips of elastic material distributed along the edges of the element, the other consisting of strips of U-shaped cross-section which are made of material with soft elastic properties and extend along respective opposite edges of the heating element. The material of the latter may consist of thermally conductive silicone rubber; the U-shaped cross-section may be open at both ends or closed by a web at at least one end.

14 Claims, 3 Drawing Figures

ELECTRICAL RESISTANCE HEATING ELEMENT

Figure 1:
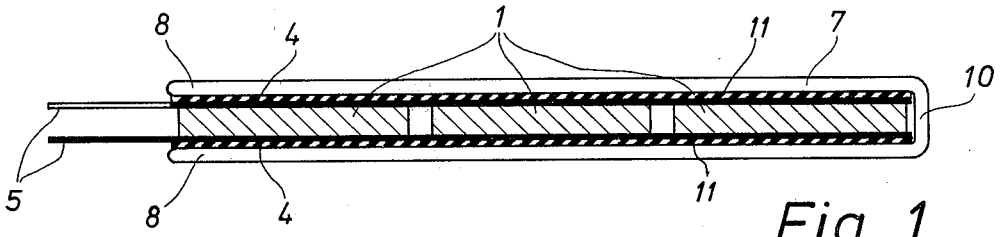

The invention relates to an electrical resistance heating element.

In electrical heating appliances, more especially electrically heated domestic appliances such as coffee-making machines, fan heaters, hair dryers etc., instead of using conventional resistance heating elements with their heating conductor made of a metal wire, increasingly use is being made of resistance heating elements whose heating conductors are one or more PTC elements, that is to say heating conductors which are made of a material with a positive temperature coefficient of electrical resistance. Such PTC elements are usually of prismatic shape with two oppositely situated plane parallel surfaces and a round or polygonal plan, are usually made of a ceramic material, more particularly with a barium titanate base, and have the property that they are virtually self-stabilising in their electrical power consumption, since the electrical resistance increases considerably in a specific temperature range. The arrangement for the electrical connection of these PTC elements is usually that the two opposite surfaces make contact through a metallised layer applied in some suitable manner and are connected to a current supply through connecting elements.

When using such PTC elements the problem exists of finding a construction which meets requirements as regards electrical connection and heat transfer. It is known from U.S. Pat. No. 4,147,927 to Pirotte to insert PTC elements in a tubular sleeve and to make the connection with resilient bars which at the same time serve for heat dissipation. It is also known from U.S. Pat. No. 4,104,509 to Bokestat et al. to connect the PTC elements with connecting wires, for example by soldering, and to embed in a housing with a thermally conductive and electrically insulating composition. These known measures can be carried out only at relatively high cost and more particularly with a considerable use of manual work, are suitable for only a very limited field of application in each case, and moreover leave a good deal to be desired as regards dissipation of heat from the PTC elements.

The invention has as its object to provide an electrical resistance heating element which can be produced in a simple and inexpensive way, can be used in very many kinds of application, and is also conducive to good heat transfer conditions.

According to the invention there is provided an electrical resistance heating element comprising at least one heating conductor in the form of an element that is provided with contact means at opposite surfaces and is made of a material with a positive temperature coefficient of electrical resistance (PTC element) and also comprising electrical connecting elements for the heating conductor, wherein the connecting elements comprise two substantially plane contact plates adapted to the layout of the PTC element or elements and placed loosely one upon the other with the PTC element or elements placed therebetween, the contact plates being held together elastically at the edges. According to the invention, therefore, electrical connection is established in that the contact plates, which are bare and electrically conductive of course at least at their internal sides facing towards the PTC elements, abut directly on the respective oppositely situated surfaces provided with contact means of the PTC elements. To produce a heating element according to the invention the PTC elements are simply stacked loose between the contact plates and held together elastically in a suitable manner which will be explained in more detail by way of example hereinafter. There are substantially no restrictions on the number and dimensions of the PTC elements. There may be one or any number of PTC elements adjacent to one another, it being simply necessary for the dimensions of the contact plates to correspond to the layout, or plan outline, of the overall arrangement of the PTC elements. Since the PTC elements can be arranged in any desired way, for example in a line one after the other, or overlying one another, an extremely large number of possible uses can be envisaged. A resistance heating element according to the invention constitutes a kind of sandwich arrangement, the elastic arrangement for holding the components together readily ensuring the necessary ease of manipulation, and giving a secure final cohesion only when mounted in the particular appliance concerned. Thus the production of the resistance heating elements is extremely simple and inexpensive, and also optimum conditions are provided for heat transfer, since the contact plates can serve at the same time—with suitable electrical insulation of course—as extensive heat transfer surfaces. With suitable layout of the appropriate heat transfer parts of an appliance, resistance heating elements according to the invention can be used for substantially all kinds of application such as flow heaters, hotplates etc. on the one hand and radiators for fan heaters, hair dryers etc. on the other hand.

If a plurality of PTC heating elements are arranged side by side it is advisable for the contact plates to be constructed so that they can bend elastically or plastically, in order that, when subjected to the action of a relatively small force compared with the pressure load acceptance ability of the PTC elements, they will yield and not introduce undue stresses into the PTC elements. The elastic cohesion of the contact plates is achieved in a particularly simple manner by holding-elements which are applied at the edges and which of course must not bring about any electrical short-circuiting of the PTC elements. The holding-elements may consist of a plurality of U-shaped clips of resilient wire whose U legs engage over the contact plates. Thus in that case a plurality of individual elements are provided, the lateral extent thereof being relatively small in relation to the dimensions of the resistance heating elements. These clips can consist of a metal spring wire covered with a suitable insulation, or of a plastic material of suitable stability to heat, and may be round in cross-section or, preferably, rectangular with the broad side parallel to the contact plates.

A constructional form which is particularly advantageous as regards production and heat transfer in the assembled state is characterised in that the holding elements consist of sectional or profiled strips of U-shaped cross-section and made of material with soft or relatively weak elastic properties, the U legs of said strips extending over the contact plates at at least two opposite sides. The longitudinal extent of these profiled strips corresponds substantially more or less to the extent of the sides of the heating element on which they are arranged, so that by placing them on two opposite sides a reliably held-together assembly is achieved. Of course the profiled strips may also extend about the entire periphery of the heating element, the strips being suitably elbowed or angled for that purpose. However, for reasons of production engineering it is recommended to use an arrangement with two profiled strips situated at opposite straight sides, preferably at the longitudinal sides for heat technique reasons in the case of a heating element of rectangular plan. The profile interior enclosed by the legs or flanges of the U and the U web of the profiled strip is advantageously open at both sides, or ends, so that the profiled strips can be produced continuously for example by extrusion. In many cases, however, it is advisable to close the interior of the profile at least at one side, or end, in fact by means of a connection between leg and web of the U-profile, said connection being preferably integral therewith. This connection, which is provided at one or both sides, or ends, and which closes the profile interior, abuts on the contact plates or the PTC elements in the assembled state and thus ensures that the profiled strips are held together in a particularly secure and reliable manner.

In every case it is advantageous to make the profiled strips from silicone rubber which has been given thermally conductive properties by suitable additives, for example MgO (magnesium oxide) or the like. This form is conducive to optimum thermodynamic conditions, and is found to be quite especially advantageous if additionally a casting-in with similar material is carried out in the finish assembled state.

At the outer sides of the contact plates electrical insulation layers are preferably provided. These insulating layers, which of course are so constructed that they prejudice the dissipation of heat from the PTC elements as little as possible, can be provided, for example in the form of a varnish, lamination or the like, fixedly on the outer side of the contact plates. A particularly advantageous constructional form has the insulating layers laid freely on the contact plates and embraced by holding elements. Thus the sandwich construction of a resistance heating element, already explained, is extended to the insulating layer also. The loose-applied insulating layers can consist for example of synthetic or—having regard to good transfer of heat—preferably natural mica.

In order that the electrical connection of a resistance heating element according to the invention can be made in a simple manner it is proposed that the contact plates are provided with formed-on connecting tongues which are preferably constructed to act as flat plug-in elements.

Figure 2:
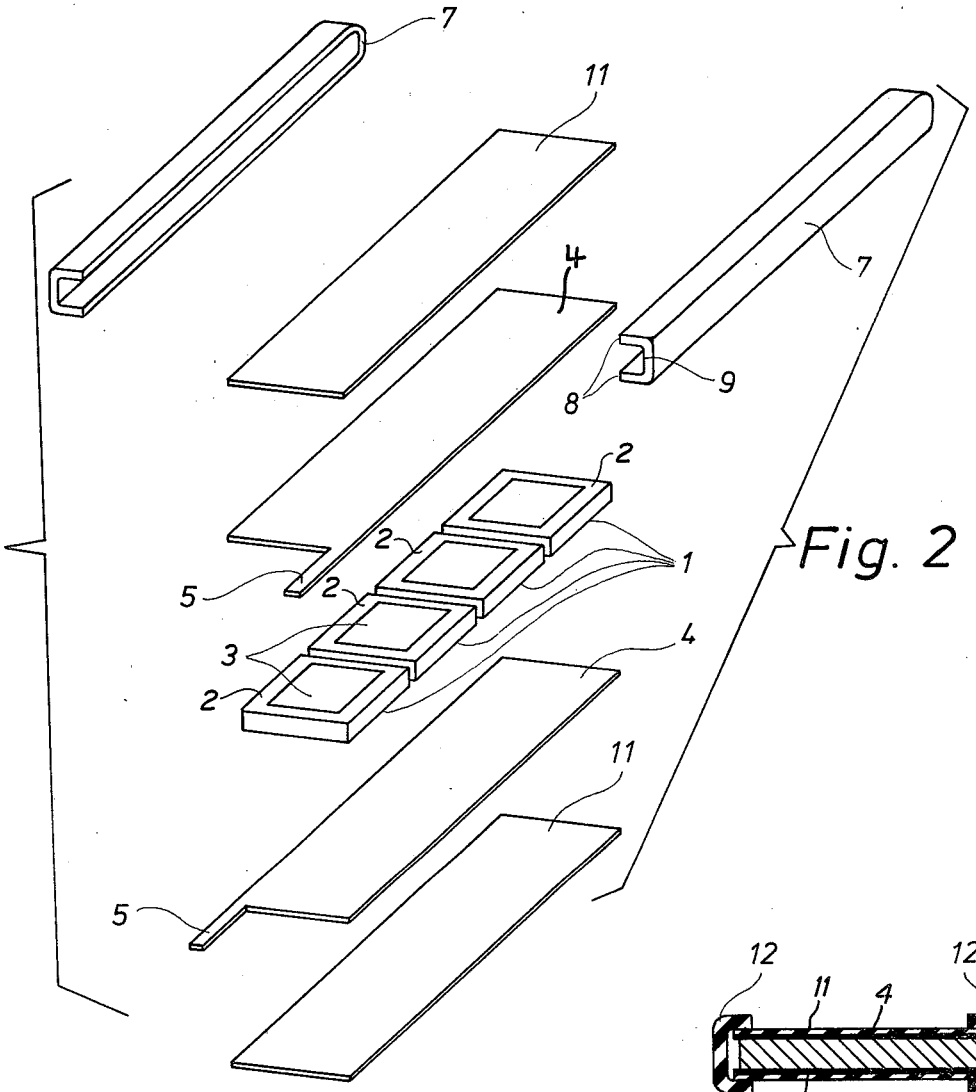
Figure 3:
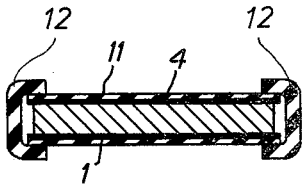

The invention will be discussed in detail hereinafter with reference to the accompanying drawings which show constructional examples. In the drawings:

FIG. 1 shows an electrical resistance heating element in longitudinal sectional view, FIG. 2 shows the subject of FIG. 1 in a perspective exploded view, FIG. 3 shows another constructional form of the subject of FIG. 1 in cross-section.

The electrical resistance heating elements shown in the drawings comprise, as regards their basic structure, a plurality of PTC elements 1 arranged in a line one after the other, or parallelepipedic form, with the oppositely situated plane parallel connecting surfaces 2 provided with a metallic contact means 3. The PTC elements 1 are arranged in sandwich form between contact plates 4 the dimensions of which correspond to the layout, or plan form, of the arrangement of the PTC elements 1. The two contact plates 4 consist of aluminium sheet and are each provided with a connecting tongue 5, the tongues being constructed as flat plug-in elements and thus allowing a cable, or flex, to be attached in a simple manner. By suitably dimensioning their thickness, the contact plates 4 can also be made flexible enough to ensure that no undue forces are introduced into the PTC elements in spite of unavoidable thickness variations between the said PTC elements due to tolerances.

The contact plates 4 with the PTC elements 1 interposed are elastically held together by holding elements applied at the edges. In the constructional example shown in FIGS. 1 and 2 these holding elements consist in each case of a profiled strip 7 of silicone rubber with soft, or relatively weak, elastic properties, of U-shaped profile with 8 designating the legs or flanges of the U and 9 the web. The profiled strip 7 is applied in such a manner that the U flanges 8 extend from the outside over the contact plates 4 and press elastically against the PTC elements 1. In the illustrated constructional example the profile interior of the profiled strips 7 is closed at one side, or end, by a connection 10 which is formed on to the U flanges and the U web, and which in the assembled state (FIG. 1) abuts on PTC element 1 and contact plates 4 and thus ensures secure seating of the profiled strip 7. As FIGS. 1 and 2 show, the profiled strips 7 are situated at the longitudinal sides of the substantially rectangular resistance heating element, and in their length correspond substantially to the extent of these longitudinal sides. Moreover in the illustrated constructional example the profile interior of the profiled strips 7 are open at that side, or end, which faces towards the connecting tongues 5.

At the outer sides of the contact plates 4, electrically insulating layers 11 are provided, which, in the constructional example shown in FIGS. 1 and 2, consist of natural split mica. These layers are placed loose on the contact plates 4 and are held together elastically with the contact plates and the PTC elements 1 by means of the profiled strips 7.

The constructional form shown in FIG. 3 corresponds generally to that shown in FIGS. 1 and 2. In this case, however, the electrically insulating layers 11 each comprise a lamination, or coating, of a plastics material of suitable heat resistance properties applied firmly to the contact plates 4. Also the holding elements in this case comprise a plurality of clips 12 at each longitudinal side of the arrangement, said clips being made of an elastic plastics material of suitable heat resistance ability and being arranged distributed at appropriate intervals over the longitudinal sides of the resistance heating element.

What is claimed is:

1. An electrical resistance heating element comprising electrical resistance heating means including at least one heating conductor element made of a material with a positive temperature coefficient of electrical resistance and having opposite substantially planar surfaces; substantially planar, electrically conductive contact means on the opposite surfaces of said heating conductor element; electrical connecting elements for said heating means including two substantially planar, electrically conductive contact plates having a size and shape corresponding substantially to the layout of the heating means and being respectively placed loosely upon the opposite surfaces of the heating conductor element so that it is sandwiched therebetween, a planar surface of each contact plate being in contact with a respective contact means on said heating conductor element, and electrical connecting terminals for said contact plates; and electrically non-conductive securing means including holding elements, each of which is applied along respective edges of the contact plates for holding the contact plates elastically against the opposite surfaces of said at least one heating conductor element at the respective edges thereof.

2. A resistance heating element according to claim 1, wherein the contact plates are flexible.

3. A resistance heating element according to claim 1, wherein said securing means comprise holding elements fitted onto the contact plates at the edges thereof.

4. A resistance heating element according to claim 3, wherein the holding elements consist of a plurality of clips which are U-shaped in cross section and made of elastic material, the legs of the U embracing the contact plates at their edges.

5. A resistance heating element according to claim 3, wherein the holding elements consist of profiled strips of U-shaped cross-section which are made of material with soft elastic properties, the legs of the U embracing the contact plates at at least two oppositely situated sides thereof.

6. A resistance heating element according to claim 5, wherein each of the profiled strips defines a profile cavity which is open at both sides.

7. A resistance heating element according to claim 5, wherein each of the profiled strips defines a profile cavity which is closed at at least one side.

8. A resistance heating element according to claim 5, wherein the material of the profiled strips consists of thermally conductive silicone rubber.

9. A resistance heating element according to claim 1, including thermally conductive electrically insulating layers at outer sides of the contact plates.

10. A resistance heating element according to claim 9, wherein the insulating layers are placed freely on the contact plates and are embraced by the holding elements.

11. A resistance heating element according to claim 1, wherein said electrical connecting terminals are electrical connecting tongues formed on the contact plates.

12. An electrical resistance heating element comprising electrical resistance heating means including a row of heating conductors each made of a material with a positive temperature coefficient of electrical resistance and having planar opposite surfaces, substantially planar, electrically conductive contact means on the opposite surfaces of said conductors, electrical connecting elements for said heating means including two substantially planar, electrically conductive contact plates corresponding substantially in size and shape to the layout of the row of heating conductors and being respectively placed loosely upon the opposite surfaces thereof, and plural electrically non-conductive securing means each of which engages the contact plates elastically along respective edges thereof to hold the contact plates against the opposite surfaces of the row of heating elements, the contact plates having a degree of flexibility for avoiding the application of undue stresses to the heating conductors.

13. A resistance heating element according to claim 12, wherein said securing means comprise two rows of clips distributed along respective edges of the heating element, each of the clips being U-shaped and made of elastic material, the legs of the U embracing the contact plates.

14. A resistance heating element according to claim 12, wherein said securing means comprise two strips of U-shaped cross-section which are made of material with soft elastic properties, said strips extending along respective edges of the heating element with the legs of the U embracing the contact plates.

* * * * *